United States Patent [19]

Sorensen et al.

[11] 4,270,783

[45] Jun. 2, 1981

[54] DOOR LOCK ACTUATOR

[75] Inventors: Ronald L. Sorensen, Rollingstone, Minn.; Dwight Whitfield, Bloomfield, Mich.

[73] Assignee: Lake Center Industries, Winona, Minn.

[21] Appl. No.: 6,040

[22] Filed: Jan. 24, 1979

[51] Int. Cl.[3] ..... E05C 13/04

[52] U.S. Cl. ..... 292/336.3; 292/201; 74/420

[58] Field of Search ..... 292/144, 201, 336.3; 74/420, 421 A, 424

[56] References Cited

U.S. PATENT DOCUMENTS

| | | | |
|---|---|---|---|
| 369,449 | 9/1887 | Hohlfelder et al. | 74/420 |
| 2,503,027 | 4/1950 | Christian | 74/421 A |
| 4,093,289 | 6/1978 | Inibayoshi et al. | 292/201 X |

*Primary Examiner*—Richard E. Moore

*Attorney, Agent, or Firm*—Kinzer, Plyer, Dorn & McEachran; Kinzer, Plyer, Dorn & McEachran

[57] ABSTRACT

An actuator for use with vehicle door locks or the like includes a housing and an electric motor positioned in the housing. A shaft is journaled in the housing and extends outwardly therefrom with an actuator member being attached to the shaft outside of the housing. A drive connection between the motor and the shaft includes a second shaft journaled in the housing and a dual gear rotatable with the second shaft. The dual gear is in driving relationship with the first shaft and with the electric motor through a bevel gear freely mounted on the first shaft.

12 Claims, 7 Drawing Figures

Fig. 1.
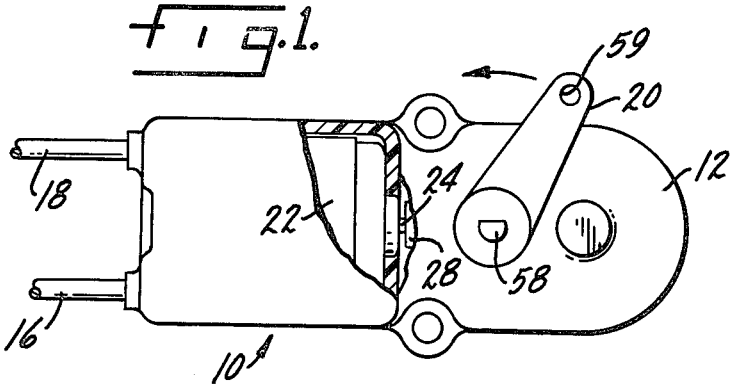
Fig. 2.
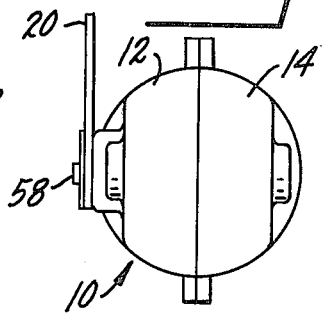
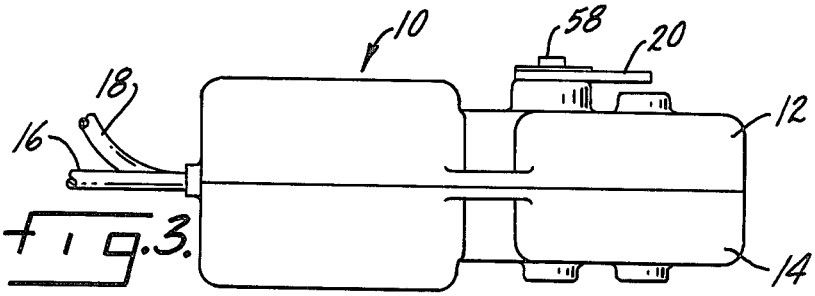
Fig. 3.
Fig. 4.
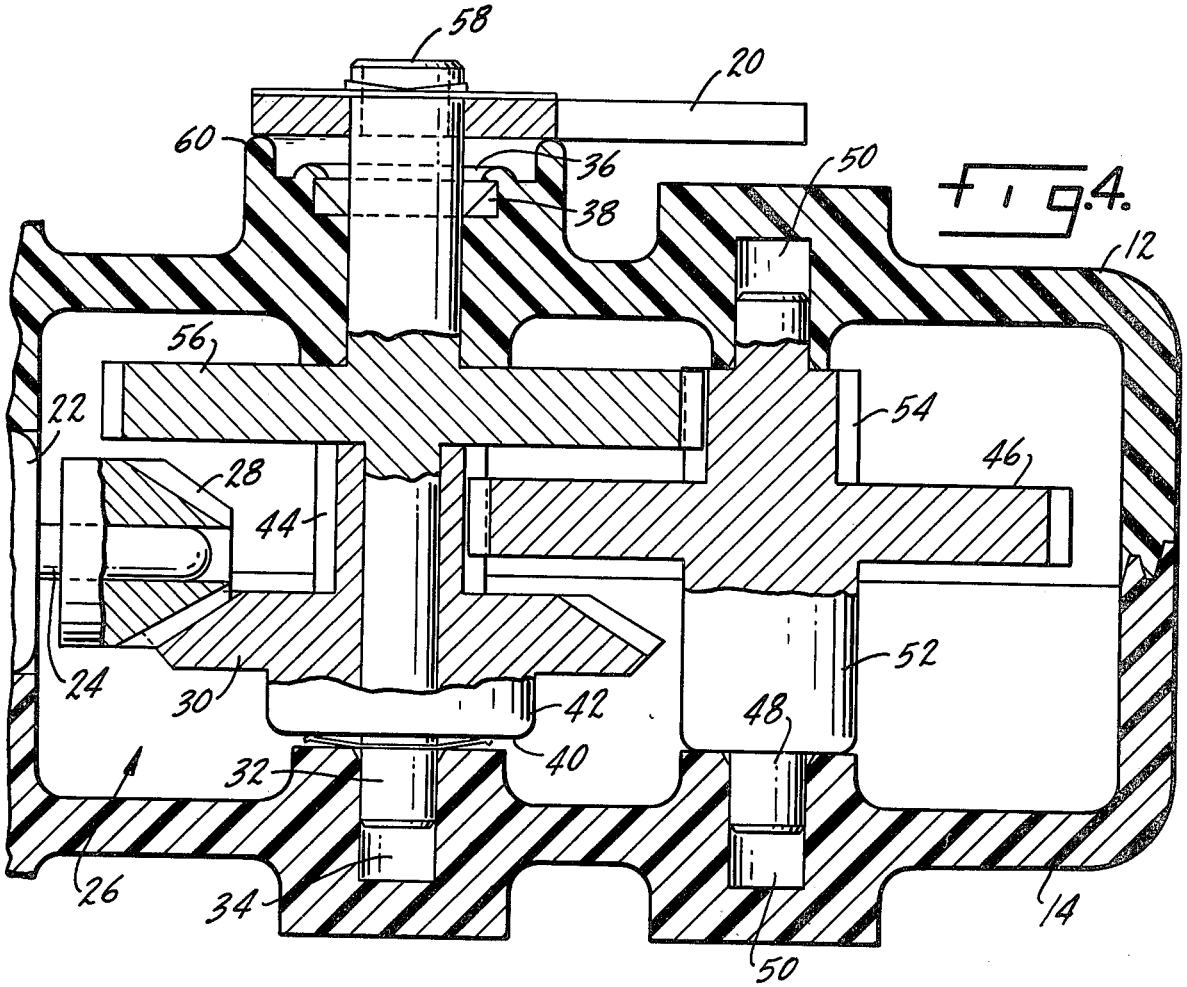

100
102
104
106
108
110
112
114
116
118
120
122
124
126
128
130
132
134
136
140
142
146
148
149
150
152
154
156
158
160
162

DOOR LOCK ACTUATOR

SUMMARY OF THE INVENTION

The present invention relates to actuators for use with vehicle door locks and is particularly related to a reliably operable compact structure of the type described.

One purpose of the invention is a simplified vehicle door lock actuator having an improved gear drive between the actuator electric motor and an exteriorly positioned actuator member.

Another purpose is an actuator of the type described including a compact easily operable and relatively inexpensive drive connection between the actuator motor and its external actuator element.

Another purpose is an actuator of the type described utilizing a pair of spaced parallel shafts, one of which is connected to an external actuator element with the other serving as a portion of the drive connection between the motor and the first shaft.

Another purpose is an actuator of the type described including a circuit breaker or switch for protecting the motor.

Other purposes will appear in the ensuing specification, drawings and claims.

BRIEF DESCRIPTION OF THE DRAWINGS

The invention is illustrated diagrammatically in the following drawings wherein:

FIG. 1 is a side view of the actuator with portions broken away;

FIG. 2 is an end view of the actuator;

FIG. 3 is a top view of the actuator;

FIG. 4 is an enlarged vertical section through a portion of the actuator as illustrated in FIG. 1;

DESCRIPTION OF THE PREFERRED EMBODIMENT

Figures 5, 6, 7:
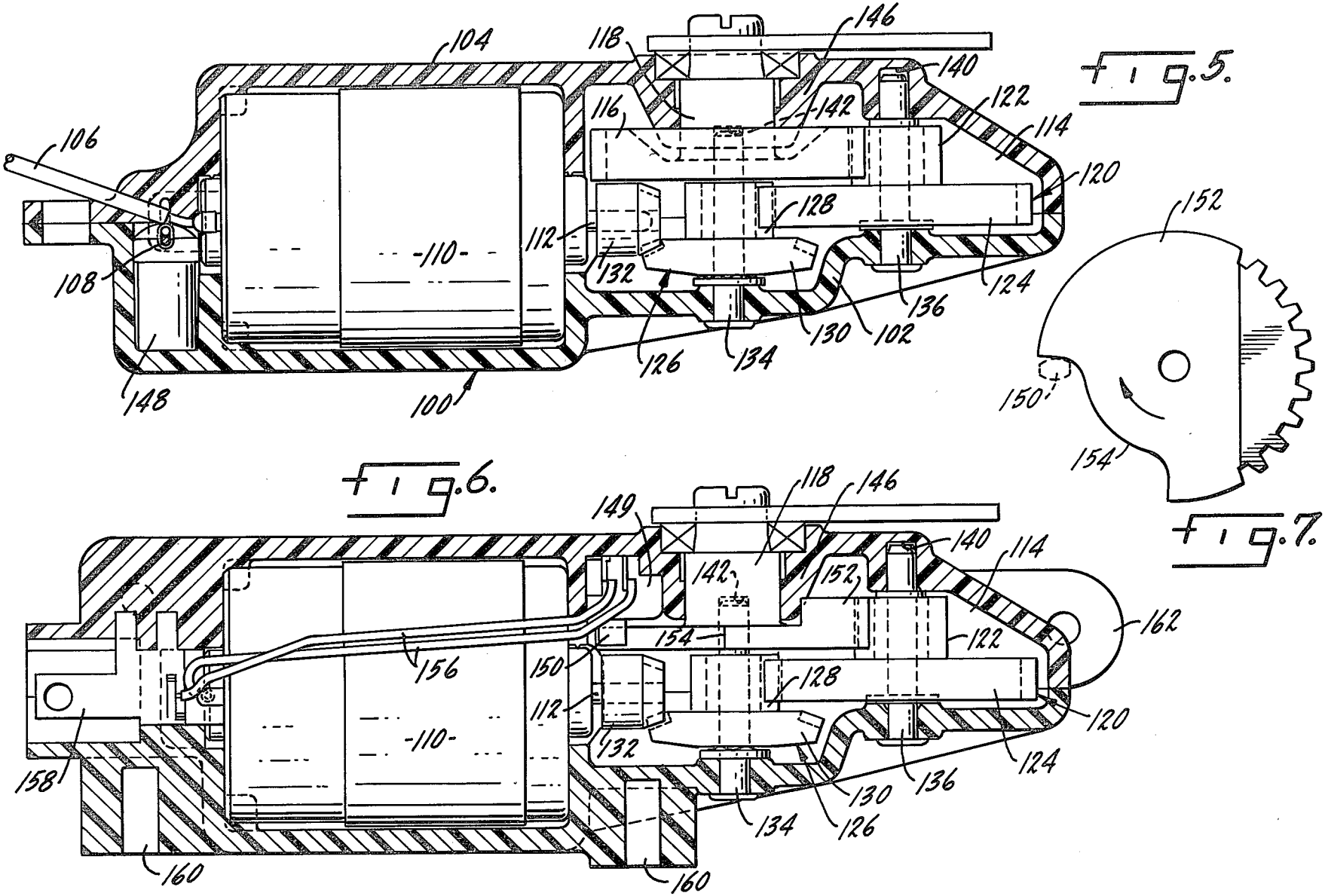
FIG. 5 is an enlarged vertical section through an alternate embodiment of the actuator.
FIG. 6 is an enlarged vertical section of a further alternate embodiment of the actuator.
FIG. 7 is a plan view of the first gear used in the embodiment of FIG. 6, showing the arcuate cutout portion and the switch lever disposed therein.

The present invention relates to electric door lock actuators of the type used with vehicles, for example, automobiles, and particularly to such a structure which is compact, reliably operable and relatively inexpensive to manufacture. Present day and future automobiles are reduced in size over the vehicles which have been marketed through the last several years. Such a reduction of size is applicable to all portions of the automobile and the vehicle doors are no exception. In order to provide a door lock actuator which will fit within currently available doors, it is necessary to provide a compact unit, one reduced in size over what has been heretofore available.

In the drawings, a housing is indicated generally at 10 and may be made up of two housing halves 12 and 14, particularly illustrated in FIG. 3. The housing may be plastic or it may be cast metal. Electric wires 16 and 18 extend outwardly from one end of the housing and will be connected to the vehicle electric system. An actuator arm 20 is pivotally mounted on the exterior of the housing to a shaft as described hereinafter. Actuator arm 20 will be connected to the door lock mechanism through a linkage not shown or disclosed herein. The actuator arm may rotate through an angle on the order of 60 degrees. It may not be necessary to have rotation through such an angle in every application, but to accommodate different lock mechanisms and due to the lack of close tolerances in the various elements which connect the actuator to the actual lock mechanism, it is necessary to have substantial movement for the actuator arm.

The drive motor, which will be an electric motor, will operate when a switch is actuated. It will operate until the crank or actuator arm has gone through its full permissible degree of rotation or until the lock mechanism has made its full excursion. If the operation switch has not at this time been released, the motor will stall. Thus, in this embodiment there is no automatic shutoff when the arm has reached a predetermined position. Rather, the motor continues to operate or stall until the operating switch is released. The alternate embodiments described below do provide automatic shutoff.

Turning particularly to FIG. 4, the electric motor is indicated diagrammatically at 22 and has an output shaft 24 extending into a chamber indicated generally at 26, which chamber houses the drive mechanism connecting the motor to actuator arm 20.

A bevel pinion 28 is attached on output shaft 24 and is in mesh with a bevel spur gear cluster 30 which is free to idle upon a shaft 32. One end of shaft 32 is journaled within a bore 34 in housing 10, whereas, the other end of shaft 32 extends outwardly through an opening 36 in housing 10 to mount actuator arm 20. A seal 38 prevents dust, dirt or the like from entering chamber 26 and forms a seal with shaft 32 at opening 36. A wave washer 40 and a spacer hub 42 may be used to control the position of bevel gear 30 on shaft 32.

Bevel gear 30 has a pinion portion 44 which extends along shaft 32 and is in mesh with a dual gear 46. Gear 46 is a part of or fastened to a shaft 48, parallel to shaft 32, which has its opposite ends journaled in bores 50 in housing 10. A spacer hub 52 may be formed as a part of dual gear 46 or shaft 48.

Dual gear 46 has a pinion portion 54 which is in mesh or in driving relationship with a spur gear 56 which is fixed to an enlarged portion 58 of shaft 32.

In operation, rotation of motor 22 drives shaft 24. Drive shaft 24 will turn bevel pinion 28 which will cause rotation of gear 30 and its associated pinion 44. These latter elements are free to rotate upon shaft 32. As pinion 44 rotates, it will drive gear 46 and its associated pinion 54. These combined elements rotate on their supporting shaft 48. Rotation of pinion 54 in turn drives gear 56 which is fixed upon the enlarged portion 58 of shaft 32. Thus, as gear 56 rotates, shaft portion 58 rotates and with it crank arm or actuator arm 20. In this connection, it should be noted that the housing has an annular shoulder 60 coaxially arranged about shaft portion 58 to support actuator arm 20. Note particularly FIG. 4 where the actuator arm is in contact with shoulder 60.

The size of the unit is relatively small and it has been found that a twelve-volt motor, customarily used in vehicle electrical systems, can provide approximately 12 lbs. of force measured perpendicular to the axis of and at the center of the linkage mounting hole of the crank arm. The crank arm has a length of approximately $1\frac{1}{2}$ inches and with approximately 12 pounds of force at center of linkage mounting hole 59 at the end of the arm, 18 inch pounds of torque are placed on shaft portion 58 of gear 56.

A first alternate embodiment of the actuator is shown in FIG. 5. This embodiment has design features which permit ease of assembly in a very compact unit. This unit is contained in a housing 100 which is designed to take up a minimum amount of space by closely surrounding the necessary contained parts. The housing may be made up of two housing halves 102 and 104. Electric wires 106 and 108 extend outwardly from one end of the housing. These will be connected to the vehicle electric system. The electric motor is indicated diagrammatically at 110. As in the above embodiment, the motor is radially mounted with an output shaft 112 extending into the gear box or chamber 114.

The drive mechanism shown in FIG. 5 is much the same as that previously described. Thus, a first spur gear 116 is attached to an output shaft 118. The first spur gear is engaged with a dual gear indicated generally at 120. The dual gear has a pinion portion 122 and a spur gear 124, these two gears being rigidly attached together.

A spur gear 124 is in mesh with a second gear indicated generally at 126. This gear is also a dual gear including a pinion portion 128 and a bevel gear 130. The bevel gear is in driving relationship with the bevel pinion 132 which is mounted on the motor output shaft 112.

While this gear train is essentially the same as in the previous embodiment, the gear mounting arrangement is altered somewhat to provide a compact structure. This is accomplished by using three shafts for mounting the gears. There is a first shaft 134 on which the second gear 126 freely rotates. This first shaft is collinear with shaft 118. A second shaft 136 is parallel to the first and output shaft.

Both the first and second shafts 134 and 136 are rigidly connected to the bottom half of the housing 102. This may be done by riveting or similar techniques. Both the dual gears 120 and 126 are free to rotate on the second and first shafts, respectively. The shafts could be made such that they are identical, thus effecting a cost savings. The second shaft 136 is held in a bore 140 in the cover portion 104 of the housing. The first shaft 134, on the other hand, extends through the spur gear 116 into a shaft mounting socket 142 cored in the center of outputs shaft 118. The output shaft in turn is held in the journal 146 of the housing cover 104.

It will be noted that the output shaft 118 and the first gear 116 are formed as one part. This permits the shaft mounting socket 142 to the cored out of the center. Thus, the first shaft 134 and the output shaft 118 are both supported in the housing by the journal. In effect, the collinear shafts operate as a single shaft because they are supported only at two points. The separation of the shafts permits an advantage when assembling the actuator. That is, both of the fixed connections with the housing halves 102 and 104 can be made before bringing the halves together. Then, when the structure is closed, the first shaft 134 fits into its socket 142 as does the second shaft 136 into its bore 140.

A circuit breaker 148 may be included to protect the motor from burnout. If the operating switch is not released after the doorlock hs been actuated, the motor will tend to stall. If this condition is not remedied, damage to the motor could result. To prevent this, the circuit breaker interrupts the supply of current to the motor until such time as the operating switch is released. The circuit breaker can consist of a bi-metallic strip positioned to alternately make or break the circuit.

FIG. 6 shows a second alternate embodiment which has a switch for motor protection purposes. The switch 149 is located in a corner of the gear box 114. This switch has a switch lever 150 which extends downwardly to a point where it engages a variation of the output gear 152. As seen in FIG. 7, the output gear 152 has a cutout portion 154 wherein the gear has a decreased radius. This arcuate cutout portion receives the switch lever 150 between its ends. The output gear 152 also has a decreased thickness which permits rotational clearance under the switch 149. Lead wires 156 connect the switch between the vehicle power supply and the motor. Terminal prongs 158 may be utilized to make the actuator a plug-in unit. Mounting holes 160 are included in the housing structure to permit mounting the units on pegs. A mounting lug 162 is included to provide a further alternate attachment point for securing the actuator.

The operation of the gear train in FIG. 6 is the same as that described in connection with the previous embodiment except for the output gear 152. When the user activates the actuator, the output gear 152 rotates through any arc from a minimum of 25 degrees to a maximum of 270 degrees as required by the application. Then the end of the arcuate cut-out 154 contacts the switch lever 150. Any further rotation causes the switch 149 to open the set of contacts then in use and close a set for reversed polarity of the motor. In this manner, the motor can be operated only so long as necessary to reverse the condition of the door locks. Once that is accomplished, current is cutoff by the switch 149 and can be re-supplied only in reversed polarity which will again change the condition of the door locks. Thus, the circuit is broken automatically and the user cannot burn out the motor.

The embodiments of the invention in which an exclusive property or privilege is claimed are defined as follows:

1. In an actuator for use with vehicle door locks or the like, a housing, an electric motor in said housing, a first shaft journaled in said housing and extending outwardly therefrom, a door lock actuator member attached to said first shaft outside of said housing, a first gear fast on said shaft, a second shaft journaled in said housing parallel to said first shaft, a dual gear rotatable with said second shaft and in driving relation with said first gear, a second gear freely rotatable on said first shaft and in driving relation with said electric motor, and a drive connection between said second gear and dual gear, rotation of said motor causing respective rotation of said second gear, dual gear, first gear and shaft thereby providing rotation of said actuator member.

2. The structure of claim 1 further characterized in that said dual gear includes a gear portion and a pinion portion, said pinion portion being in mesh with said first gear.

3. The structure of claim 2 further characterized in that said second gear includes a gear portion and a pinion portion, with said second gear pinion portion being in mesh with said dual gear.

4. The structure of claim 3 further characterized in that said second gear has a beveled gear surface, a bevel pinion attached to the output of said electric motor and in mesh with said beveled gear surface.

5. The structure of claim 4 further characterized by and including spring means positioned between said second gear and said housing urging said second gear toward a predetermined position.

6. The structure of claim 4 further characterized in that said first shaft has a portion of reduced diameter mounting said second gear.

7. The structure of claim 1 further characterized by and including an annular shoulder on said housing coaxial with said first shaft, said shoulder forming a bearing surface for said actuator member.

8. In an actuator for use with vehicle door locks or the like, a housing, an electric motor in said housing, an output shaft journaled in said housing and extending therethrough, a door lock actuator member attached to the end of the output shaft outside of said housing, a first gear integrally formed on the inside end of the output shaft, the first gear having a shaft mounting socket in its center, a first shaft, colinear with the output shaft, having one end mounted to said housing and the other end held in the shaft-mounting socket, a second shaft mounted in said housing parallel to the first and output shafts, a fual gear rotatable on the second shaft and in driving relation with the first gear, a second gear freely rotatable on the first shaft and in driving relation with the electric motor, and a drive connection between the second and dual gears, rotation of the motor causing respective rotation of said second gear, dual gear, first gear and output shaft thereby providing rotation of the actuator member, a switch mounted in said housing, the first gear further including an arcuate cutout portion of decreased radius, the switch having a lever disposed within the arcuate cutout portion so as to be actuatable by the gear when it rotates through an arc greater than that of the cutout portion, the switch being operable to shut off the motor and alter the polarity of the motor contacts so that the actuator is prepared for operation in the opposite direction of that just completed.

9. The structure of claim 8 further characterized in that said dual gear includes a gear portion and a pinion portion, said pinion portion being in mesh with said first gear.

10. The structure of claim 9 further characterized in that said second gear includes a gear portion and a pinion portion, with said second gear pinion portion being in mesh with said dual gear.

11. The structure of claim 10 further characterized in that said second gear has a beveled gear surface, a bevel pinion attached to the output of said electric motor and in mesh with said beveled gear surface.

12. The structure of claim 8 further comprising a circuit breaker mounted within the housing for protecting the motor from burnout due to prolonged current supply after maximum rotation of the actuator member.

* * * * *